United States Patent [19]

Cagnioncle

[11] 4,359,115

[45] Nov. 16, 1982

[54] NOVEL ROTARY DRILL BITS AND DRILLING PROCESS

[75] Inventor: Georges Cagnioncle, Lyons, France

[73] Assignee: Construction de Materiels de Mines S.A., Mulhouse, France

[21] Appl. No.: 128,412

[22] Filed: Mar. 10, 1980

[30] Foreign Application Priority Data

Mar. 8, 1979 [FR] France ..... 79 05922

[51] Int. Cl.[3] ..... E21B 10/60

[52] U.S. Cl. ..... 175/393; 175/67

[58] Field of Search ..... 175/67, 70, 393, 421, 175/418, 65, 215, 15

[56] References Cited

U.S. PATENT DOCUMENTS

| | | | |
|---|---|---|---|
| 880,880 | 3/1908 | Hardsocg | 175/419 |
| 1,297,708 | 3/1919 | Maier | 175/393 X |
| 1,388,490 | 8/1921 | Suman | 175/393 X |
| 1,465,407 | 8/1923 | Bashara | 175/421 |
| 1,882,268 | 10/1932 | Appleman | 175/421 |
| 2,822,148 | 2/1958 | Murray | 175/421 |
| 3,096,103 | 7/1963 | Murphy | 175/215 X |
| 3,155,180 | 11/1964 | MacSween | 175/418 |
| 3,645,346 | 2/1972 | Miller et al. | 175/393 X |
| 3,881,561 | 5/1975 | Pols et al. | 175/67 X |
| 4,073,351 | 2/1978 | Baum | 175/15 X |

FOREIGN PATENT DOCUMENTS

| | | | |
|---|---|---|---|
| 36913 | 9/1970 | Australia | 175/329 |

*Primary Examiner*—Ernest R. Purser
*Attorney, Agent, or Firm*—Millen & White

[57] ABSTRACT

A rotary drilling bit is provided which includes means for providing a protective stream of a high pressure fluid for its cutting edges fed parallel to the drilling axis directed perpendicular to the cutting edges. The drilling bit also includes means for providing a stream of low pressure fluid for flushing away pulverized rock cut by the drilling bit. The drilling bit is mounted on the end of boring tubing made up of a pair of coaxially positioned tubings, the innermost one supplies the high pressure fluid and the outermost one supplies the low pressure fluid. A drilling process which employs the drilling bit and boring tubing efficiently drills through both soft and non-abrasive rock and hard or abrasive rock.

9 Claims, 8 Drawing Figures

NOVEL ROTARY DRILL BITS AND DRILLING PROCESS

BACKGROUND OF THE INVENTION

This invention relates to novel rotary drill bits suitable for cutting semi-hard, hard and abrasive rocks and to a novel boring or drilling process employing the novel rotary drill bits.

Drill holes in mines, quarries and analogous mining or prospecting ground generally have a diameter of 30 to 200 mm. Two types of drill bits are presently used for boring these holes, the choice between them is dictated by the nature of the rocks through which the hole must be drilled. For non-abrasive rocks having a hardness value of less than 800 bars, such as limestone or marl, rotary drill bits can be used. However, for harder or more abrasive rocks, such as sandstone or granite, rotary drill bits are not efficient enough and percussive hammers or rotopercussion drill bits are used. The latter are more powerful but are more complex and thus more costly. Moreover, the noise level associated with their use is higher, therefore more disturbing.

In both types of drilling bits, rock is cut by cutter edges reinforced by plates of tungsten carbide. In both cases, dust which develops during drilling is discharged by a fluid injected into the bore hole through the drill tubing. The fluid is usually water under pressures ranging between 0 and 40 bars, or air under a pressure of about 5 bars. In order to achieve more efficacious boring, the use of water jets having very high pressures on the order of up to 4000 bars has been considered. However, this method is not commercially feasible since the energy costs are excessive. Furthermore, the use of these high pressure jets does not lead to uniform results since softer grounds are preferentially attacked.

It is therefore an object of the present invention to provide a novel drilling bit which can be used efficiently to drill both non-abrasive softer rock, and harder or abrasive rock. It is another object to provide a novel cutting edge for such drill bits. It is a further object to provide a novel drilling process which employs such a novel drilling bit. Other objects of the invention will be apparent to those skilled in the art to which the present invention pertains.

To achieve these objects, the invention includes a rotary drive bit characterized by a cutting edge which is protected by a fluid film or fluid jets under a pressure of 1000 to 4000 bars which are directed or passed from the drill bit parallel to the drilling axis and perpendicular to the cutting edges.

In another article of manufacture aspect, the invention relates to a novel cutting edge for rotary drill bits which comprises means for injecting from the drill head a small quantity of fluid under very high pressure parallel to the boring axis of the rotary drill bit and perpendicular to the cutting edges.

The invention relates to novel boring tubing which comprises means for introducing fluid under very high pressure, and means for introducing fluid under low pressure, both of which are adapted for use in combination with the novel drill bit cutter edge of the invention.

In a further article of manufacture aspect, the invention relates to a novel rotary drill bit outfitted with two fluid injection means and adapted for use with the novel cutting edge and the novel boring tubing of the invention.

In a process aspect, the invention relates to a novel drilling method which employs one or more of the novel boring tubing, cutting edge and rotary drill bit of the invention.

The cutting edge according to this invention is comprises at least one inserted plate which includes at least one miniature hole, adapted to release a fluid, preferably water under a very high pressure, e.g., 1000 to 4000 bars, at a fluid flow rate of 5 to 25 liters/min. The water under high pressure is passed from the drill bit, from a position forward from the cutting edge in the direction of rotation, parallel to the axis of drilling to form a protective film over the cutting edge. The cutting edge also comprises one laterally positioned larger hole (ranging between 1 to 8 mm, for example) for passing a low pressure fluid, e.g., air or water. When air is used, the pressure is generally in the range of about 5 bars, and in the case of water, the pressure is generally about 0 to 40 bars. This supplementary injection is primarily intended to carry away, through the borehole, the rock particles produced from the boring resulting from the combined action of the cutting edge and the high pressure fluid, because the flow rate of the high pressure fluid, viz., 5 to 25 liters/min, is insufficient to ensure a quick enough removal of the cutting dust which is necessary to enable rapid drilling of the borehole.

The bit body is attached to boring tubing made up of two concentric tubes providing respective fluid injection circuits connected to the corresponding smaller and larger holes of the cutting edge.

The rotary drilling machine which is operatively connected to the boring tubing supporting the cutting edge also comprises a double fluid injection circuit.

DESCRIPTION OF THE DRAWINGS

The characteristics of the present invention will be described in more detail in the following description referring to the annexed drawings, in which.

DETAILED DISCUSSION OF THE INVENTION

Figure 1:
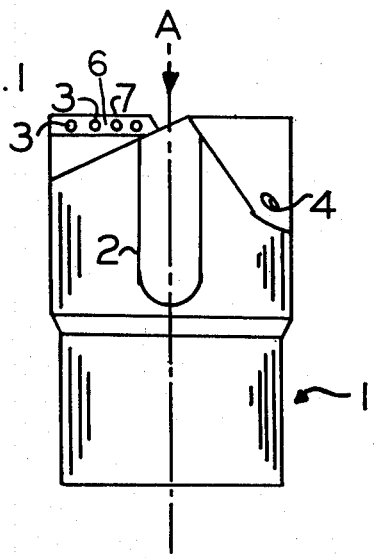
FIG. 1 is a side elevation view of a cutting edge according to this invention.
Figure 2:
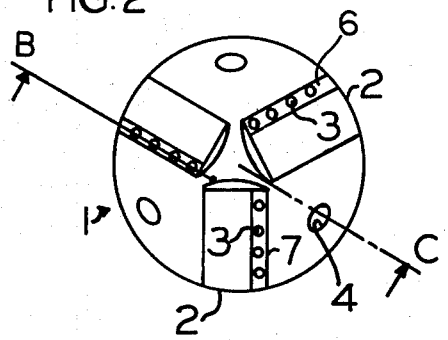
FIG. 2 is a top plan view of an embodiment of a cutting edge according to this invention.

The bit body 1 shown in FIG. 1 is of the type provided with skirts. However, any other conventional type can be used. The bit body 1 is fitted with a cutting plate 2 made of tungsten carbide or a like very hard material. When there are 2, 3 or 4 such plates, they are symmetrically disposed relative to the central axis of the cutting edge. The most common devices, such as the one shown in FIG. 2, are equipped with 3 plates spaced at angles of 120° . However, devices with 2 plates, are spaced to define angles of 180°, or with 4 plates, angles of 90° can also be used.

Figure 3:
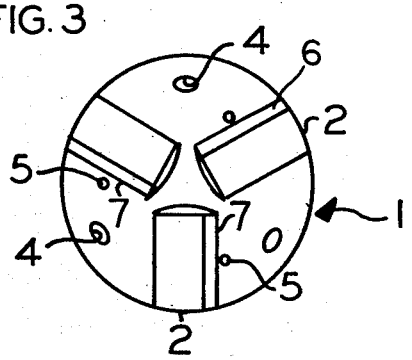
FIG. 3 is a top view from above of another embodiment of a cutting edge according to this invention.

Each one of plates 2 is perforated with a plurality of tiny (1–50 microns) holes 3 extending along and on the cutter surface or beveled face 6 of the blade edge 7 of plate 2. These holes provide exit apertures for high pressure water. High pressure water is passed outwardly from the holes 3 in a direction parallel to the drilling axis and forms a protective film over the blade edge 7. Each plate 2 has located forwardly thereto, (in the direction of rotation), a larger hole 4 having a diameter from 1 to 8 mm, opening into the cutting edge, and disposed at the base of the cutting plate 2 where rock chips are evacuated. The larger hole 4 provides an exit aperture for low pressure fluid. According to the embodiment of the invention shown in FIG. 3, which otherwise corresponds to the embodiment of FIG. 2, high pressure fluid holes 5 are positioned in the cutting edge bit body 1 proximate to and forward of plate 2 in the direction of rotation. The position of the larger holes 4 for the low pressure fluid are the same as shown in the embodiment of FIG. 2.

Figure 4:
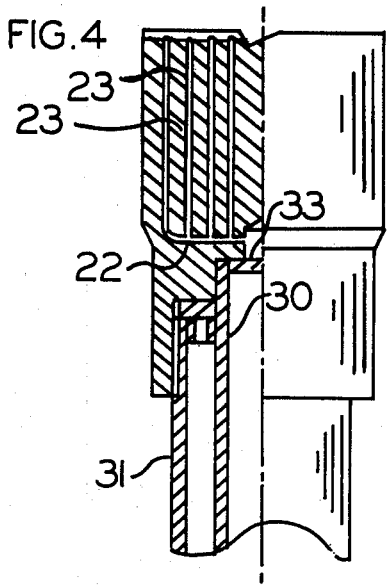
FIG. 4 is a side elevation view in partial cross section along the line B—B of the cutting edge FIG. 2.
Figure 5:
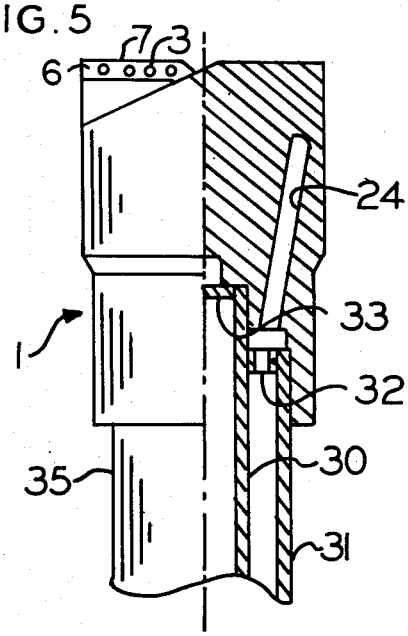
FIG. 5 is a side elevation view in partial cross section along the line C—C of the cutting edge FIG. 2.
Figure 7:
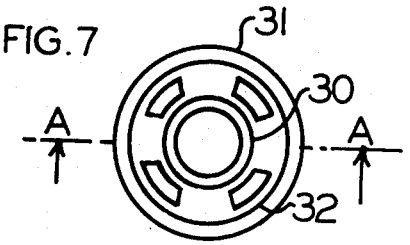
FIG. 7 is an axial cross-sectional view from above of the bore tubing of FIG. 6.

FIGS. 4 and 5 show in more detail how fluid is fed to the bit body 1. In FIG. 4, the high pressure fluid holes 3 of the embodiment of FIG. 2 are positioned at the ends of a corresponding number of ducts 23 which are connected to a common duct 22, oriented inwardly toward the center of the drill body and which in turn is in communication with the central tubing 30 of the drilling tubing 35, through which high pressure fluid is pumped. FIG. 5 shows the low pressure duct 24 which connects hole 4 with the annularly extending space disposed between tubings 30 and 31 through which low pressure fluid is pumped. The bit body 1 is mounted on outer tubing 31, e.g., by screw threads (not shown), and rests on internal tubing 30 through joint 33. Device 32 of the star connection type, rigidly interconnects tubings 30 and 31, as shown in FIG. 7.

Figure 6:
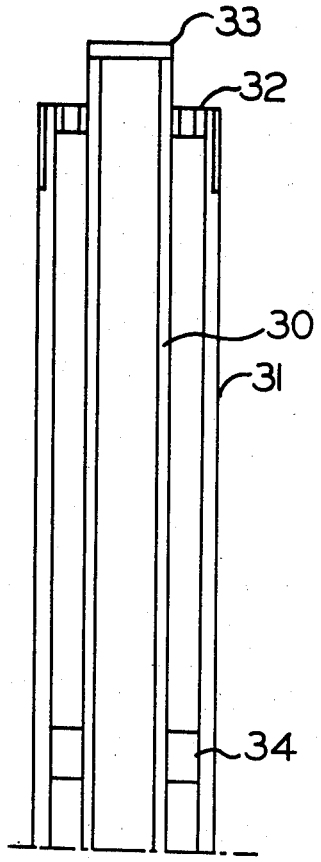
FIG. 6 is a longitudinal cross-sectional view along line A—A of FIG. 7, of a bore tubing according to this invention.

As also shown in FIG. 6, drilling tubing 35 consists of concentric tubings 30 and 31 having the centrally located tubing 30 of small diameter used for the feeding of high pressure fluid and outer tubing 31 is used for the feeding of low pressure fluid. The size of these tubings varies with the size of the borehole to be drilled. For example, for a borehole having a diameter of 30 mm, the outer tubing 31 generally has an outer diameter of 25–27 mm and the inner tubing 30 has a diameter of 7–8 mm. For boreholes having a diameter of about 200 mm, the outer tubing 31 generally has an outer diameter of about 90 mm and the inner tubing 30 a diameter of about 20 mm. The two tubings are interconnected through a suitable securing or tightening device, such as the star connection device shown in FIG. 7. The two tubes are coaxially positioned with respect to each other along the length of the drilling tubing 35 by a plurality of shoes 34, around which the low pressure fluid passes.

Figure 8:
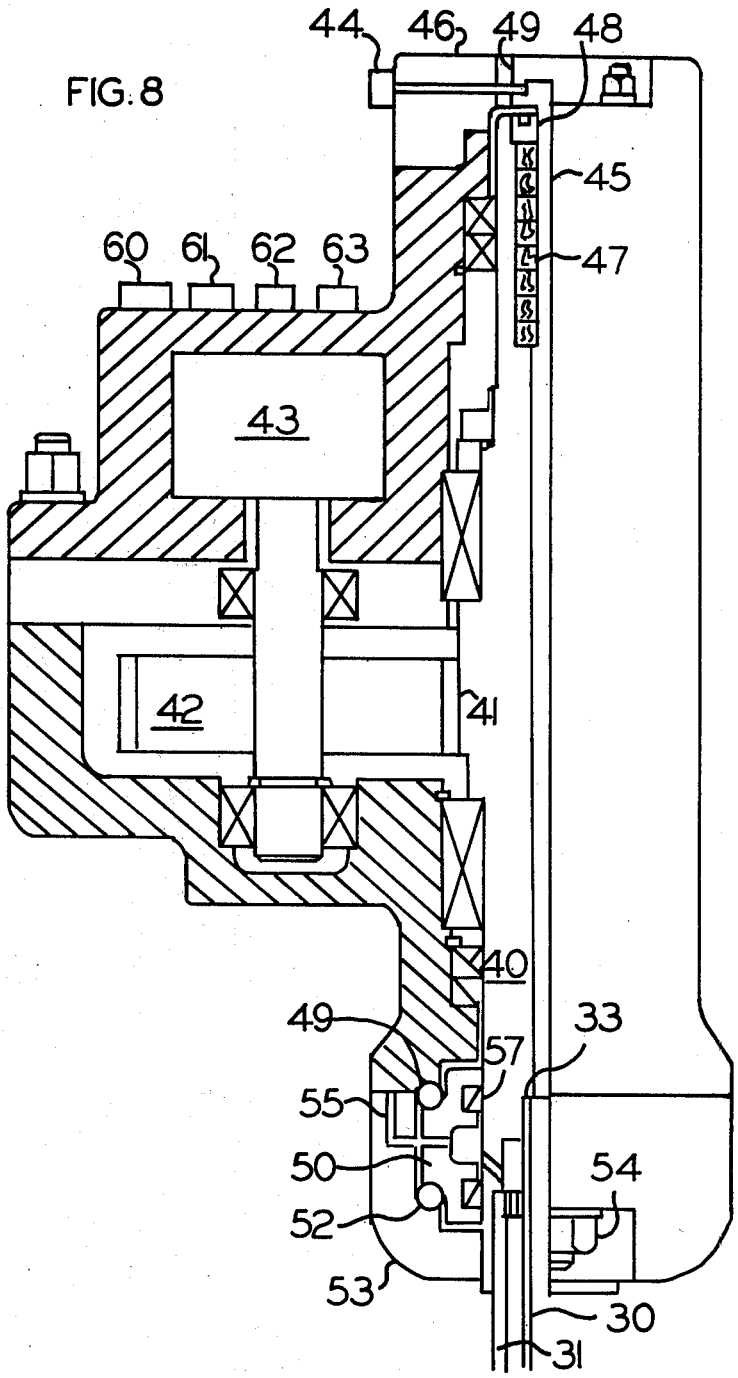
FIG. 8 is a side elevation view of a drilling bit according to this invention, partly broken away.

The rotary drilling bit shown in FIG. 8 has a rotating boss (or hub) 40 outfitted with a double injection device.

The upper end of outer tubing 31 has screw threads to permit the boss (or hub) 40 of the drilling bit to be mounted thereon. As shown in FIG. 6, its lower end is also threaded to receive the bit body 1. The boss (or hub) 40 is rotated by gears 41 and 42 driven by a hydraulic motor 43. High pressure water is fed into boss (or hub) 40 through a needle 45 formed of alloy steel and welded onto a plate 46. Needle 45 is fed through a flexible duct connected at 44 onto plate 46. The tight fit at the junction between the needle and the boss (or hub) is obtained by felt-piling joints 47 which are compressed by a stuffing box 48. Openings 49 for removing leakage water are provided in the lower part of plate 46 and in front of the casing. The other end of the boss (or hub) 40 is attached to the drilling tubing 35. The high pressure device is thus connected to inner tube 30, which is held in position by outer tube 31 screwed into the boss (or hub) 40, fluid tightness being obtained by joint 33. The low pressure fluid injection is made on the side of the drill bit. The front casing of the drill bit is fitted with a floating ring 50 held in position by joints 52. The floating ring is guided by the boss (or hub) 40 and fluid tightness is ensured by joints 51. Nuts 54 rigidly secure casing 53. The injected fluid flows through casing 53, then in between ring 51 and boss (or hub) 40 through opening 55. In the assembled tubing, the low pressure fluid flows through the annulus between tubes 30 and 31. In the rear part of the drilling bit are provided ports for motor oil and for fluid injection, viz., an oil intake port 60 and an oil return port 61. Oil leakage, if any, is removed through port 62. Low pressure fluid is injected through fluid inlet port 63 and high pressure fluid through fluid inlet port 44.

In operation, the plates 2 and the film of high pressure fluid which is formed by being passed from the openings 3 in a direction parallel to the drilling axis collectively ensure efficient boring. The low pressure fluid lays the protective dust when water is used, and carries it out of the borehole. In the case of soluble ores, where the quantity of water used must be limited, the low pressure fluid is preferably air and performs only the function of cleaning the borehole and the dust is laid down by high pressure water discharged through the tiny holes 3 or 5. When boring hard or semi-hard rocks, the use of this novel drilling bit permits significant savings in the cost of the cutting edges and drilling tubings. The purchase and maintenance cost compared to the rotopercussion drill bits most often used is lower. Additionally, drilling is less objectionable because the sound level is lower by about 20 decibels.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A rotary drill bit comprising a body having at least one cutting plate with a cutting edge and a cutting face thereon, and means for passing a protective stream of high pressure fluid outwardly from the drill bit in a direction perpendicular to said one cutting edge and parallel to the axis of drilling, said means for passing a protective stream of high pressure fluid comprising at least one small fluid exit porthole located in said one cutting face for passing the stream of high pressure fluid therethrough in a manner such as to provide a film for protecting said cutting edge.

2. A rotary drill bit according to claim 1 wherein said means for passing said protective stream is adapted for passing said protective stream on the side of said cutting edge facing the direction of rotation of said rotary drill bit.

3. A rotary drill bit according to claim 1 wherein said means for passing said protective stream is adapted for passing substantially all of the high pressure fluid in a direction perpendicular to said at least one cutting edge.

4. A rotary drill bit comprising a body having at least one cutting plate with a cutting edge and a cutting face thereon, and means for passing protective stream of high pressure fluid outwardly from the drill bit in a direction perpendicular to said at cutting edge and substantially parallel to the axis of drilling along the greater portion thereof, said one cutting edge having a leading edge in the direction of rotation of the drill bit, and said means for passing a protective stream comprising at least one small fluid exit porthole located in said cutting face and slightly forward in the direction of rotation of the leading edge of said at least one cutting edge for passing the protective stream of high pressure fluid therefrom in a manner such as to provide a film for protecting said at least one cutting edge.

5. A rotary drill bit according to claim 1 or 4 further comprising at least a second larger fluid exit porthole positioned forward relative to the direction of rotation of the drill bit, of the at least one exit porthole, for permitting lower pressure fluid to exit from the interior of the drill bit.

6. A rotary drill bit according to claim 5 further comprising coaxially positioned tubings with the innermost tubing in fluid connection with said at least one smaller fluid exit port, and the outer tubing in fluid connection with said at least one larger fluid exit port.

7. A rotary drill bit according to claim 6 further comprising a boss (or hub) which comprises a centrally positioned device for feeding the high pressure fluid through the outermost tubing.

8. A rotary drill bit comprising a body having at least one cutting plate with a cutting edge and a cutting face thereon, and fluid means for passing a protective stream of high pressure fluid from the drill bit in a direction parallel to the axis of drilling, said fluid means comprising at least one first smaller fluid exit porthole located in said cutting face at a position relative to said cutting edge for allowing high pressure fluid to be exhausted from the interior of the drill bit in a manner such as to form a protective film over said cutting edge, and a second larger fluid exit porthole relative to said first smaller fluid exit porthole, positioned forward with respect to the direction of rotation of the drill bit from said first smaller fluid exit porthole for passing lower pressure fluid from the interior of the drill bit for carrying off through the borehole, when drilling operations are being conducted therein, rock particles produced by boring resulting from the combined action of the cutting edge and the high pressure fluid.

9. A rotary drill bit according to claim 1 or 8 having at least one cutting edge with a perforated leading edge and comprising, first connecting means to connect the perforations to a source of high pressure fluid and further comprising a corresponding larger fluid exit port positioned, relative to the direction of rotation of the drill bit, forward of said perforations, and second connecting means for connecting said corresponding larger exit port to a source of lower pressure fluid.

* * * * *